US005430243A

United States Patent [19]

Shioda

[11] Patent Number: 5,430,243

[45] Date of Patent: Jul. 4, 1995

[54] SOUND EFFECT-CREATING DEVICE

[75] Inventor: Kazuaki Shioda, Shizuoka, Japan

[73] Assignee: Kabushiki Kaisha Kawai Gakki Seisakusho, Shizuoka, Japan

[21] Appl. No.: 127,353

[22] Filed: Sep. 28, 1993

[30] Foreign Application Priority Data

Sep. 30, 1992 [JP] Japan ..... 4-285126
Sep. 30, 1992 [JP] Japan ..... 4-285127

[51] Int. Cl.[6] ..... G10H 1/057
[52] U.S. Cl. ..... 84/645; 84/701
[58] Field of Search ..... 84/601, 602, 609, 614, 84/626, 631, 645, 649, 701, 708

[56] References Cited

U.S. PATENT DOCUMENTS 4,681,008 7/1987 Morikawa et al. .
4,744,281 5/1988 Isozaki .
4,922,797 5/1990 Chapman ..... 84/650
4,970,935 11/1990 Morikawa et al. ..... 84/603

*Primary Examiner*—Vit W. Miska
*Attorney, Agent, or Firm*—Evenson, McKeown, Edwards & Lenahan

[57] ABSTRACT

A sound effect-creating device for imparting a sound effect to a musical tone produced by performance delays a musical tone signal of an analog or digital type by a predetermined delay time to repeatedly generate the musical tone. The predetermined delay time is set based on a basic delay time determined from the period of a timing clock of a MIDI signal received from an external electronic musical instrument. Alternatively, the period of a timing clock of a MIDI signal is determined from a basic delay time set for determining the predetermined delay time.

7 Claims, 7 Drawing Sheets

SOUND EFFECT-CREATING DEVICE

BACKGROUND OF THE INVENTION

1. Field of the Invention

This invention relates to a sound effect-creating device used in electronic musical instruments and the like, and more particularly to a sound effect-creating device which is adapted to determine a predetermined delay time based on a repetition period of a timing clock of a MIDI signal, or vice versa, in imparting a repeat effect to a musical tone.

2. Prior Art

It is a known excellent technique in playing musical instruments or singing in chorus, to delay musical tones produced by the instruments or voices of singers by the use of a delay device to impart a repeal effect thereto, and thereby make particular potions of the performance or the chorus emphatic or impressive. To make use of this technique, a sound effect-creating device comprising such a delay device is generally used today, i.e., at the age of rapid progress in the art related to electronic musical instruments, to impart a repeat effect to the performance.

In imparting a repeat effect to the performance and/or song (hereinafter simply referred to as "the performance") by the use of such a sound effect-creating device, it is a conventional method that an operator of the sound effect-creating device calculates a delay time based on the tempo of the performance, whenever it is required, or determines the delay time by the use of a converting table set therefor, and then the thus obtained delay time is set to the delay device of the sound effect-creating device.

However, this method has the following inconveniences: First, it is naturally required to make the tempo of performance of a musical instrument playing an accompaniment completely synchronous with the delay time for delaying the musical tone of the performance. Otherwise, the repeated tone or the delayed musical tone does not agree with the accompaniment, and impedes the performance to the contrary. According to the conventional method, the delay time of the sound effect-creating device for delaying the musical tone is set by the operator separately from the electronic musical instrument for the accompaniment, which prevents the tempo of the accompaniment of the electronic musical instrument from being completely synchronous with the delay time for delaying the musical tone. Furthermore, if the tempo of the performance or the accompaniment is changed during the performance, it is impossible to change setting of the delay time, since this will impede progress of the performance.

Secondly, such calculation or use of a converting table in determining a delay time is not preferred, since it is not only troublesome but also unbecoming to the performance of music which should be based on sensitivity by nature.

SUMMARY OF THE INVENTION

It is a first object of the invention to provide a sound effect-creating device which is capable of automatically delaying a musical tone by a delay time corresponding to the tempo of an electronic musical instrument connected thereto to thereby impart an excellent repeat effect to the performance.

It is a second object of the invention to provide a sound effect-creating device which is capable of determining the tempo of performance of an electronic musical instrument connected thereto in a manner corresponding to a delay time for delaying a musical tone.

To attain the first object of the invention, according to a first aspect of the invention, there is provided a sound effect-creating device for imparting a repeat effect to a musical tone produced by performance, including delay means for delaying a musical tone signal of analog or digital type by a predetermined delay time for repeatedly generating the musical tone, the sound effect-creating device comprising:

MIDI signal-receiving means for receiving a MIDI signal for control of a musical instrument;

basic delay time-calculating means for calculating a basic delay time based on a period of a timing clock of the MIDI signal received by the MIDI signal-receiving means; and delay time-setting means for setting the predetermined delay time based on the basic delay time calculated by the basic delay time-calculating means.

According to the sound effect-creating device of the first aspect of the invention, the predetermined delay time is determined based on the period of the timing clock of the MIDI signal received from the electronic musical instrument. Therefore, it is possible to impart a repeat effect to the performance while making the tempo of performance of the electronic musical instrument in agreement with the delay time of the musical tone delayed.

Preferably, the sound effect-creating device includes tempo determining means for determining the tempo of the performance of the musical tone based on the period of the timing clock of the MIDI signal received by the MIDI signal-receiving means, and the basic delay time-calculating means calculates the basic delay time based on the tempo determined by the tempo determining means.

Further preferably, the delay time-setting means includes meter-setting means for setting a parameter indicative of a meter of the musical tone, and sets the predetermined delay time based on the basic delay time, and depending on the parameter indicative of the meter of the musical tone.

According to this preferred embodiment of the invention, it is possible to change the delay time alone without changing the tempo of the performance calculated based on the period of the timing clock of the MIDI signal. Therefore, if the meter of performance of the electronic musical instrument is not synchronous with that of the musical tone while the tempo of the former is identical to that of the latter, it is possible to change the delay time such that a repeated tone is added to the musical tone, which agrees not only with the tempo bust also with the meter of the performance of the musical instrument.

To attain the second object of the invention, according to a second aspect of the invention, there is provided a sound effect-creating device for imparting a repeat effect to a musical tone produced by performance, including delay means for delaying a musical tone signal of analog or digital type by a predetermined delay time for repeatedly generating the musical tone, the sound effect-creating device comprising:

basic delay time-setting means for setting a basic delay time for use in setting the predetermined delay time;

MIDI signal-delivering means for delivering a MIDI signal for control of a musical instrument;

timing setting means for setting a period of a timing clock of the MIDI signal based on the basic delay time set by the basic delay time-setting means.

According to the sound effect-creating device of the second aspect of the invention, the period of the timing clock of the MIDI signal transmitted to an external electronic musical instrument is determined based on the period of the basic delay time set by the basic delay time-setting means. Therefore, it is possible to make the tempo of performance of the external electronic musical instrument in agreement with the delay time of the musical tone delayed, to thereby impart an excellent repeat effect to the performance.

Preferably, the basic delay time-setting means includes tempo determining means for determining the tempo of the performance of the musical tone, and sets the basic delay time based on the tempo and set by the tempo setting means.

Further preferably, the delay time-setting means further includes meter-setting means for setting a parameter indicative of a meter of the musical tone, and sets the predetermined delay time based on the tempo set by the tempo setting means and the parameter indicative of the meter of the musical tone.

According to this preferred embodiment of the invention, it is possible to change the delay time alone without changing the period of the timing clock of the MIDI signal. Therefore, if the meter of performance of the electronic musical instrument is riot synchronous with that of the musical tone while the tempo of the former is identical to that of the latter, it is possible to change the delay time for delaying the musical tone such that the meter of the musical tone becomes synchronous with that of performance of the electronic musical instrument.

The above and other objects, features, and advantages of the invention will become more apparent from the ensuing detailed description taken in conjunction with the accompanying drawings.

DETAILED DESCRIPTION

The invention will now be described in detail with reference to the drawings showing preferred embodiments thereof.

Figure 1A:
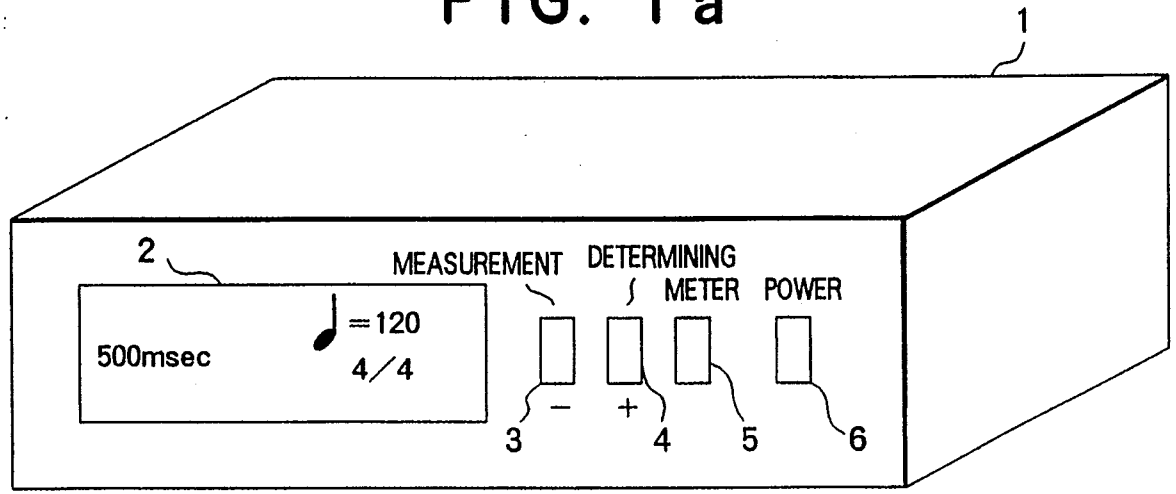
FIG. 1*a* is a diagram showing an appearance (front) of a sound effect-creating device according to a first embodiment of the invention.
Figure 1B:
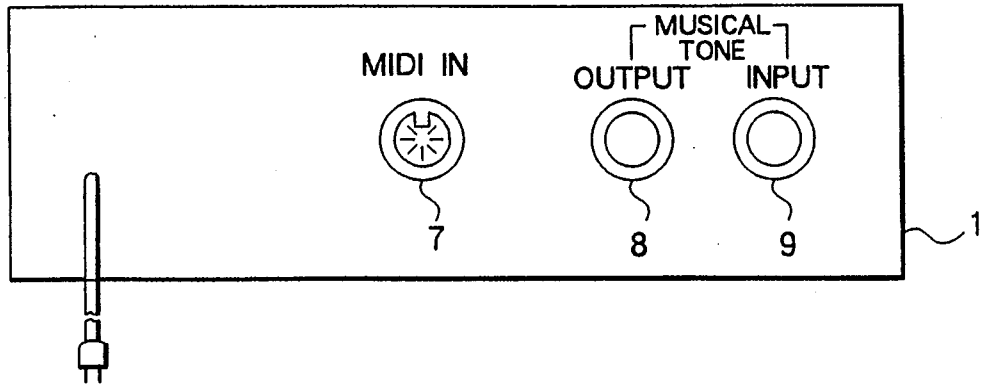
FIG. 1*b* is a diagram showing an appearance (rear) of the sound effect-creating device according to the first embodiment.

First, the construction of a sound effect-creating device according to a first embodiment of the invention will be described with reference to FIG. 1*a*, FIG. 1*b* and FIG. 2. FIG. 1*a* and FIG. 1*b* shows appearances of the sound effect-creating device 1. On the front of the sound effect-creating device shown in FIG. 1*a*, there are arranged a display 2, a measurement switch 3, a determining switch 4, a meter setting switch 5, and a power switch 6. On the rear of same shown in FIG. 1*b*, there are arranged a MIDI signal connector 7, a musical tone output connector 8, and a musical tone input connector 9.

The display is formed of liquid crystal, and displays a basic delay time for delaying a voice and/or a musical tone produced by an electronic musical instrument and the like, a tempo of performance of an external electronic musical instrument for accompaniment calculated based on a timing clock of a MIDI signal, and a meter for changing or setting a delay time based on the basic delay time.

The measurement switch 3 and the determining switch 4 are both of a push-button type. When the measurement switch 3 is depressed, a basic delay time-calculating routine for calculating a basic delay time based on a timing clock of a MIDI signal is started. When the determining switch is depressed, a main routine for delaying the musical tone by a predetermined time period is started. These routines will be described in detail hereinbelow.

Figure 4:
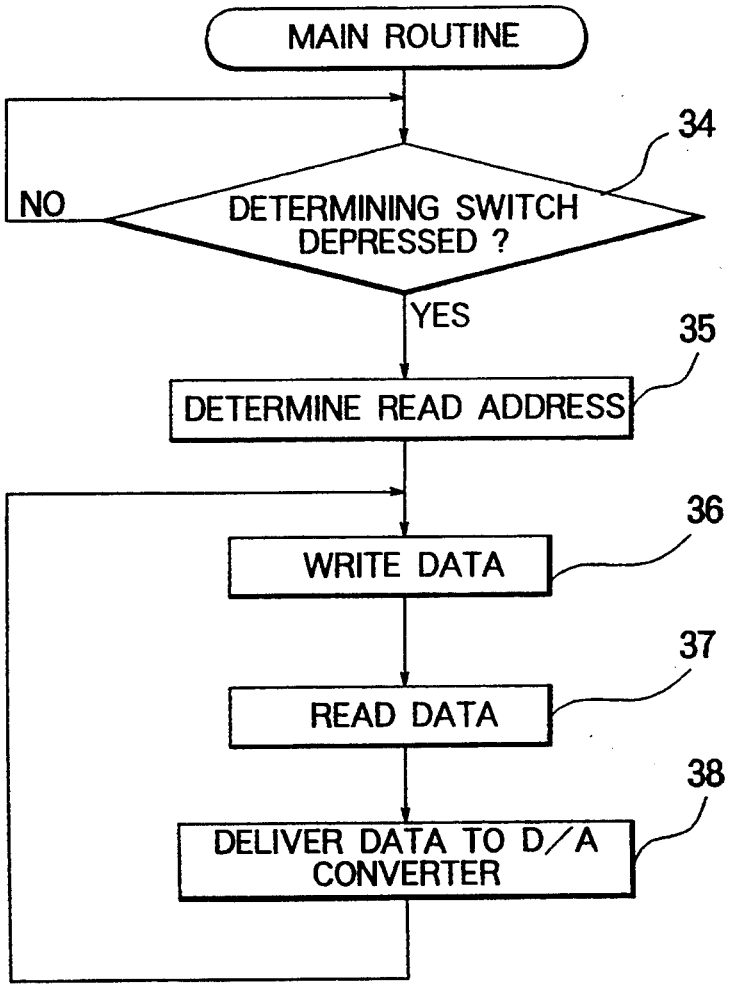
FIG. 4 is a flowchart of a main routine for controlling the operation of the sound effect-creating device according to the first embodiment.

The meter setting switch 5 is operated to input a parameter indicative of a meter of the musical tone to be delayed to the sound effect-creating device. When the meter setting switch 5 is operated, a meter is displayed on the display 2, and the delay time is set based on the basic delay time and in a manner corresponding to the parameter set by the switch 5. Therefore, it is possible to change the delay time for delaying the musical tone such that it suits a desired meter without changing the tempo or speed of performance calculated from the timing clock of the MIDI signal. A manner of determining the delay time depending on the meter will be described in detail hereinbelow when a manner of determination of a read address, which is carried out at a step 35 of a main routine shown in FIG. 4, is described. When the meter setting switch 5 is not operated, no meter is displayed on the display, and the delay time is set to the basic delay time. The power switch 6 is also of a push-button type. When the power switch 6 is depressed, the power starts to be supplied to the sound effect-creating device 1.

The MIDI signal connector 7 receives a MIDI signal for timing clock-based synchronous control of electronic musical instruments meeting the MIDI standard requirements which employ a sequencer or a computer. A signal of the timing clock from an external electronic musical instrument, not shown, is received via the MIDI signal connector 7.

The musical tone output connector 8 and the musical tone input connector 9 are provided for receiving and outputting a signal indicative of a musical tone, repeatedly. The musical tone output connector 8 is connected to an audio amplifier, while the musical tone input connector 9 is connected to a microphone, an electronic musical instrument other than the aforementioned external musical instrument, or the like.

Then, referring to FIG. 2, there will be described the whole arrangement of the sound effect-creating device which is common to the first and second embodiments thereof. As shown in FIG. 2, the sound effect-creating device 1 comprises a CPU 11, an analog-to-digital (A/D) converter 12, a digital-to-analog (D/A) converter 13, a switch interface 14, a display interface 15, a program ROM 16, a RAM 17, a MIDI block 18, and a delay RAM 19.

More specifically, the CPU 11 is formed by a microcomputer, and controls various operations of the sound effect-creating device including a musical tone signal-delaying operation, a delay time-setting operation, and reception of data of a MIDI signal. The A/D converter 12 converts an analog signal indicative of the musical tone into a digital signal. The D/A converter 13 converts a digital signal into an analog signal. The switch interface 14 delivers ON/OFF signals set by the switches 3, 4, and 5 to the CPU 11. The display interface 15 converts data of the basic delay time, etc. read from the CPU 11 into data for display and supplies the resulting data to the display 2.

The program ROM 18 stores programs for operating the CPU 11. The RAM 17 temporarily stores therein data of values of the basic delay time and the tempo as results of calculation by the CPU 11. The MIDI block 18 converts serial data of the timing clock of the MIDI signal received from the external electronic musical instrument, not shown, via the MIDI signal connector 7 into a signal receivable by the CPU 11. The delay RAM 19 temporarily stores the digital signal. The delay RAM 19 is not particularly limited, but it may contain a memory area consisting of an address 0000 to an address FFFF, each of which address can store three bytes of data of the digital signal.

Next, a manner of use of the sound effect-creating device 1 will be briefly described. A musical tone as an object of delaying in imparting a repeat effect to the performance is not particularly limited, but if a repeat effect is to be added to a song formed of voices, a microphone is connected to the musical tone input connector 9 to thereby input a signal of a musical tone (of the song) to the sound effect-creating device 1. The musical tone output connector 8 is connected to the audio amplifier, and an output block thereof is connected to a loudspeaker. Further, the MIDI signal connector 7 is connected to an external electronic musical instrument, not shown.

When the MIDI signal is received from the external electronic musical instrument, and the measurement switch 3 is depressed, measurement of the basic delay time is started. During measurement, both indications of the basic delay time and the tempo on the display 2 flicker. When a measured value of the basic delay time becomes stable or constant, the determining switch 4 is depressed, and accordingly the indications of the basic delay time and the tempo cease to flicker to be in a fixedly lighted state. At the same time, the signal indicative of the musical tone input via the musical tone input connector 9 is delayed based on the basic delay time indicated on the display, and then delivered from the musical tone output connector 8.

The basic delay time is normally indicates a delay time corresponding to duration of one quarter note, and depending on conditions of the performance, i.e. depending on the meter of the musical tone, the delay time may be set or changed by operating the meter setting switch 5, as will be described hereinafter, in a manner corresponding to one to several half note(s), quarter note(s), eighth note(s), sixteenth note(s) , etc.

Thus, the signal indicative of the musical tone input to the sound effect-creating device 1 is delivered to the audio amplifier from the musical tone output connector 8 after the lapse of the delay time determined based on the basic delay time (and the meter) indicated on the display 2. Then, the audio amplifier mixes the signal indicative of the musical tone directly input thereto from the microphone and the delayed signal of same input thereto from the sound effect-creating device 1, and delivers the resulting signal to a loudspeaker, not shown, which generates a mixed tone consisting of the original musical tone which is not delayed and the delayed musical tone, imparting a repeat effect to the performance.

In addition, when the tempo of performance of the external electronic musical instrument for accompaniment is changed during the performance, the period of the timing clock of the MIDI signal is simultaneously changed. Therefore, the sound effect-creating device constantly measures the period of the timing clock, and the basic delay time and the tempo indicated on the display as well as the delay time for delaying the musical tone are changed in a manner corresponding to the period of the timing clock.

Figure 5:
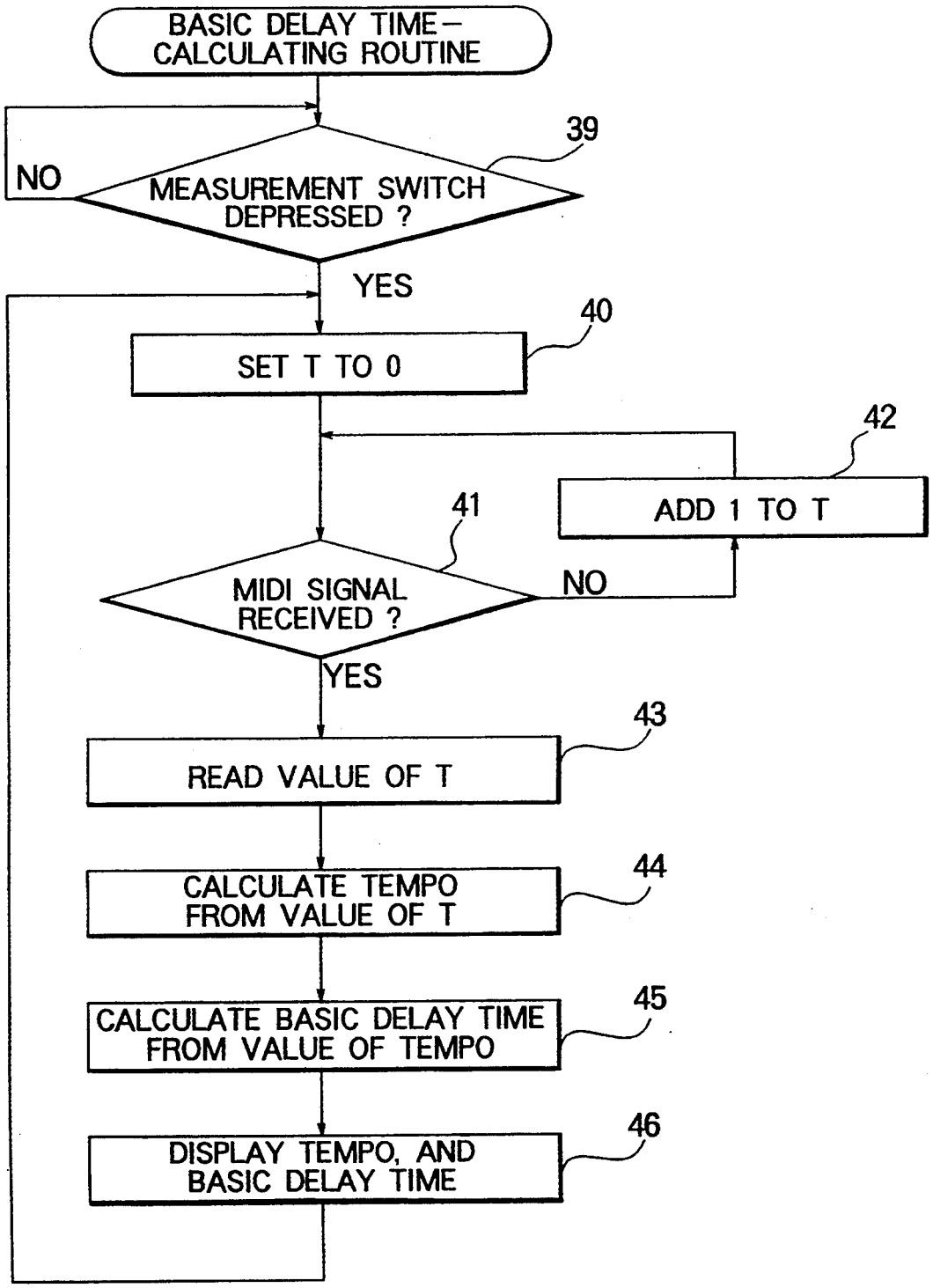
FIG. 5 is a flowchart of a basic delay time-calculating routine for calculating a basic delay time, which is executed by the sound effect-creating device according to the first embodiment.
Figure 6A:
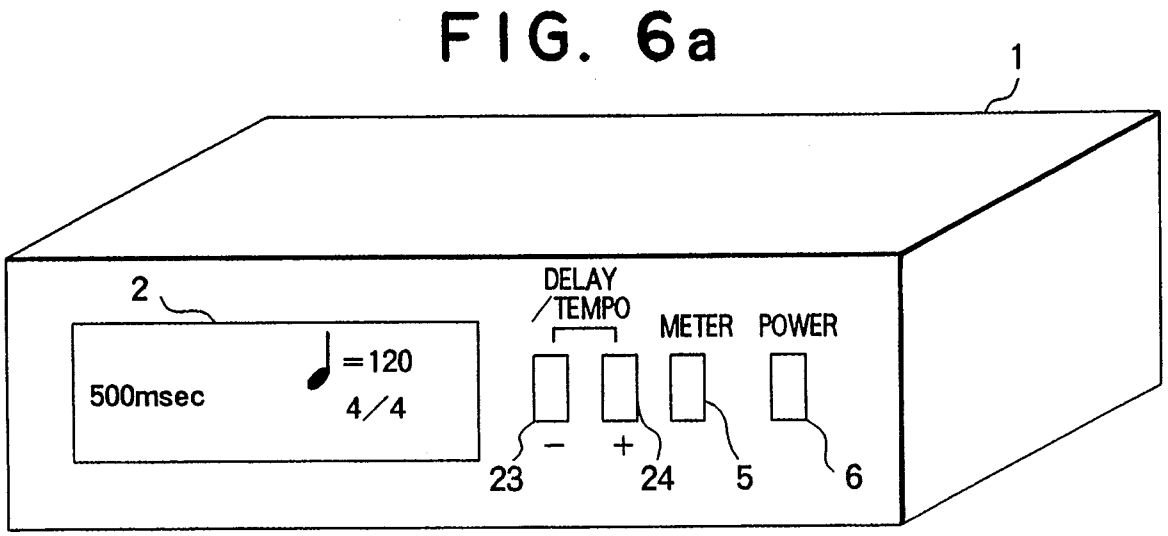
FIG. 6*a* is a diagram showing an appearance (front) of a sound effect-creating device according to the second embodiment.
Figure 6B:
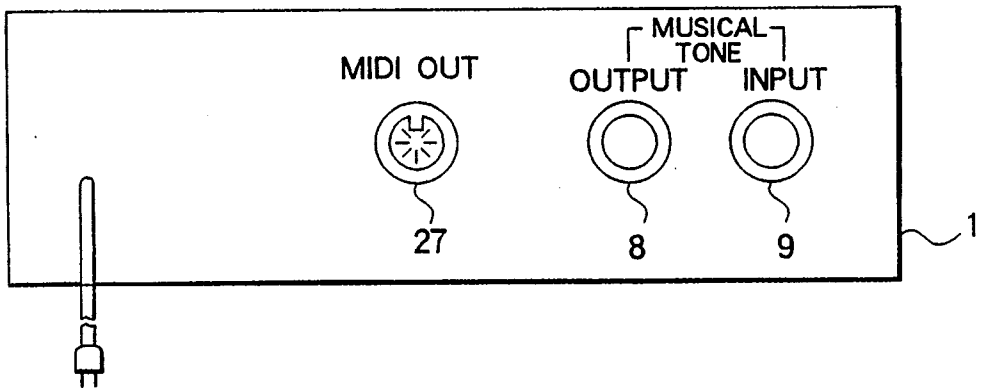
FIG. 6*b* is a diagram showing an appearance (rear) of the sound effect-creating device according to the second embodiment.

Next, the operation of the sound effect-creating device 1 will be described in detail with reference to FIG. 3 to FIG. 5.

Figure 3:
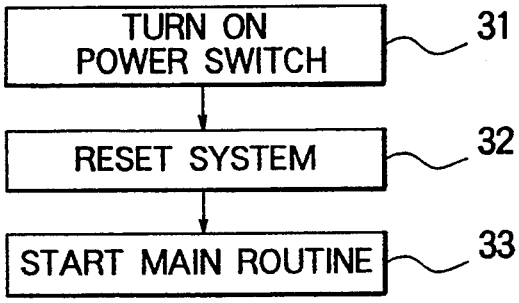
FIG. 3 is a flowchart of a starting routine for starting the sound effect-creating device according to the first and second embodiments.

FIG. 3 shows a starting routine for starting the sound effect-creating device 1. First, when the power switch 6 is turned on, a predetermined power starts to be supplied to the sound effect-creating device 1 at a step 31. The CPU 11 resets the system in a predetermined manner according to a program stored in the program ROM 16 at a step 32, and then starts a main routine or a program shown in FIG. 4 for delaying a musical tone, at a step 33.

The FIG. 4 main routine is carried out in the following manner:

The CPU 11 constantly monitors an ON/OFF signal supplied via the switch interface 14 from the determining switch 4 at a step 34. When the determining switch 4 is depressed, the CPU 11 stores data of the basic delay time calculated by a basic delay time-calculating routine, described hereinafter, into the RAM 17, and then determines a read address of the delay RAM 19 frown which the data of the signal of the musical tone should be read, in a manner corresponding to the delay time for delaying the musical tone. A manner of determination of the read address will be described below.

Then, an analog signal of the musical tone is converted into a digital signal by the A/D converter 12, and data of the digital signal (hereinafter referred to as "the data") is written into the delay RAM 19 via a system bus 20 at a step 36. Storing of the data into the delay RAM 19 is carried out in the following manner: First, a data piece is written into an address 0000 of the delay RAM 19. Then, in the following loop, i.e. after execution of the main routine once, the data piece stored in the address 0000 is moved into the next address 0001, and then the following data piece is written into the address 0000. Such a procedure is repeatedly carried out for all the following pieces of the data whenever the main routine is executed, whereby the first data piece stored is sequentially moved from the address 0000 toward the address FFFF, and all the following data pieces are stored in a predetermined address area having a predetermine sequence of the addresses from 0000 to FFFF at a step 36.

Then, at a step 37, the data piece is read out from the read address determined at the step 35, and the read data piece is supplied to the D/A converter 13 at a step 38. In this connection, the read address is determined in the following manner: As describe above, the address of each piece of the data is moved to a larger address by one address whenever the main routine is executed. Therefore, a time period required to elapse for each data piece to move to a larger address by one address corresponds to an interval of execution of the main routine. Accordingly, a numerical value obtained by dividing the delay time by the interval of execution of the main routine is set to the number of the read address. If data are constantly read from the thus determined read address, it means that the data of the musical tone are constantly read out after the lapse of the delay time.

The read address determined at the step 35 corresponds to the basic delay time equivalent to duration of one quarter note provided that the meter setting switch 5 has not been operated, and hence it will now be called "the basic read address" assuming the meter setting switch 5 has been operated. When the delay time is determined in a manner suitable for the meter of the musical tone, the read address is determined according to the meter set by the meter setting switch 5 in the following manner: A reference value of 1 is assigned to one quarter note, while reference values of 4, 2, 0.5, and 0.25 are assigned to one whole note, one half note, one eighth note, and one sixteenth note, respectively. By multiplying a value of the basic read address corresponding to one quarter note calculated above by the product of selected one of these reference values and the number of beat of the meter, and then reading the data stored at a read address having the thus obtained value, it is possible to delay the musical tone in a manner corresponding to the meter of the performance or the musical tone. For example, if the musical tone is delayed by a time period corresponding to two quarter notes in agreement with two-four meter, the data are read from a read address which has $1\times2$ times as large an address value as the basic read address. If the musical tone is delayed by a time period corresponding to three eighth notes in agreement with three-eight meter, the data are read from a read address which has $0.5\times3=1.5$ times as large an address value as the basic read address. In addition, in the case of delay based on notes of a kind other than the above-mentioned ones, a reference value of one note of this kind is determined in a manner proportional to duration of one note of this kind.

The basic delay time-calculating routine will now be described with reference to FIG. 5. According to this routine, the tempo of the performance of the external electronic musical instrument and the delay time for delaying the musical tone are determined based on the period of timing clock of the MIDI signal. More specifically, this routine is carried out in the following manner: The CPU 11 constantly monitors the ON/OFF signal supplied from the measurement switch 3 via the switch interface 14 at a step 39. When the measurement switch 3 is depressed, i.e. when the ON signal is detected, the CPU 11 sets T to 0 at a step 40. The symbol T designates a variable for measuring a period of a timing clock of a MIDI signal, which is not particularly limited, and set in the present embodiment such that a value of $T=1$ corresponds to a time period of 20.8 μsec.

The CPU 11 constantly monitors whether the MIDI signal is supplied thereto via the MIDI block 18 at a step 41. The value of T is incremented by 1 at a step 42 if no MIDI signal is input, and these steps 41 and 42 are repeatedly carried out so long as no MIDI signal is input. If the MIDI signal is input, a value of T assumed then is read at a step 43, and the value of T is multiplied by a unit time period of 20.8 μsec. and the resulting product is set to the period of the timing clock of the MIDI signal. Then, the tempo is calculated at a step 44.

Now, the calculation of the tempo will be described assuming that the period of the timing clock is equal to 20.8 μsec.$\times1000=20.8$ msec. More specifically, according to the MIDI standard, the timing clock (F8H) is defined as the system real time message. According to the definition, twenty-four timing clocks are transmitted per one quarter note. The tempo is defined as the number of quarter notes counted per one minute. In the present case, since the period of the timing clock is assumed to be 20.8 μsec., the number of timing clocks per one minute is approximately 2880. Therefore, the tempo, which is the number of quarter notes (one quarter note corresponding to 24 timing clocks), can be calculated by dividing the number of timing clocks counted per minute by 24. Thus obtained value of the tempo, i.e. the resulting quotient, is approximately 120.

Then, the basic delay time is calculated based on the thus obtained value of the tempo at a step 45. The basic delay time, which is equal to duration of one quarter note, can be calculated by dividing 60 seconds by the value of the tempo (i.e. the number of quarter notes per minute). Therefore, in the above case, the basic delay time is equal to 500 msec.

Data of the tempo and the basic delay time calculated as above are converted into data for display, which in turn are supplied via the display interface 15 to the display 2 at a step 46, followed by the program returning to the step 40 to repeatedly carry out the basic delay time-calculating routine.

In this connection, after the measurement switch 3 has been depressed, if the period of the timing clock of the MIDI signal is changed, the basic delay time-calculating routine is carried out and then the main routine is automatically executed to automatically change the basic delay time and the tempo as well as indications thereof on the display, and also the delay time dependent on the basic delay time for delaying the musical tone.

In addition, although, in the present embodiment, the tempo of the performance of the external electronic musical instrument is calculated from the period of the timing clock supplied therefrom, and based on a value of the tempo, the basic delay time is calculated, this is not limitative, but since the relationship of the period of the timing clock, the tempo, and the basic delay time is invariably determined, it goes without saying that the basic delay time can be directly calculated from the period of the timing clock.

As described heretofore, according to the present embodiment, the basic delay time is calculated based on the period of the timing clock of the MIDI signal, and the delay time is determined based on the basic delay time thus obtained, and further depending on the meter of the performance of the instrument, if required. Therefore, the delay time can be made synchronous not only with the tempo of the performance of the electronic musical instrument but also with the meter thereof. Therefore, an excellent repeat effect can be imparted to the musical tone.

Next, the second embodiment of the invention will be described with reference to FIG. *6a*, FIG. *6b*, FIG. 2, and FIG. 7 to FIG. 10.

This embodiment is distinguished from the first embodiment in that the delay time is not determined based on the period of the timing clock of the MIDI signal received from an external electronic musical instrument, but conversely, the period of the timing clock of the MIDI signal transmitted to an external electronic instrument is determined based on the delay time set by the operator. In the following description and related figures, elements and components identical or similar to those of the first embodiment are designated by identical reference numerals, and detailed description thereof is omitted.

FIG. *6a* shows an appearance (front) of the sound effect-creating device according to the second embodiment of the invention. In the figure, reference numerals 23, 24 designate push-button switches for setting the basic delay time and the tempo. More specifically, when the switch 23 is depressed, the delay time for delaying the musical tone is set to a shorter period, and a value of the basic delay time indicated on the display 2 is also set to a smaller value. At the same time, a value of the tempo indicated on the display 2 increases as the basic delay time decreases. Conversely, when the switch 24 is depressed, the delay time is set to a longer time period, and hence a value of the basic delay time indicated on the display 2 increases, with the tempo indicated on the display 2 being set to a smaller value accordingly.

FIG. *6b* shows an appearance (rear) of the sound effect-creating device of the second embodiment. In the figure, the MIDI signal connector 27 is a connector from which is transmitted the MIDI signal to an electronic musical instrument conforming to the MIDI standard in which a sequencer or a computer is used, for synchronous control thereof. A signal of the timing clock is delivered via the MIDI signal connector 27 to the electronic musical instrument, not shown.

Figure 2:
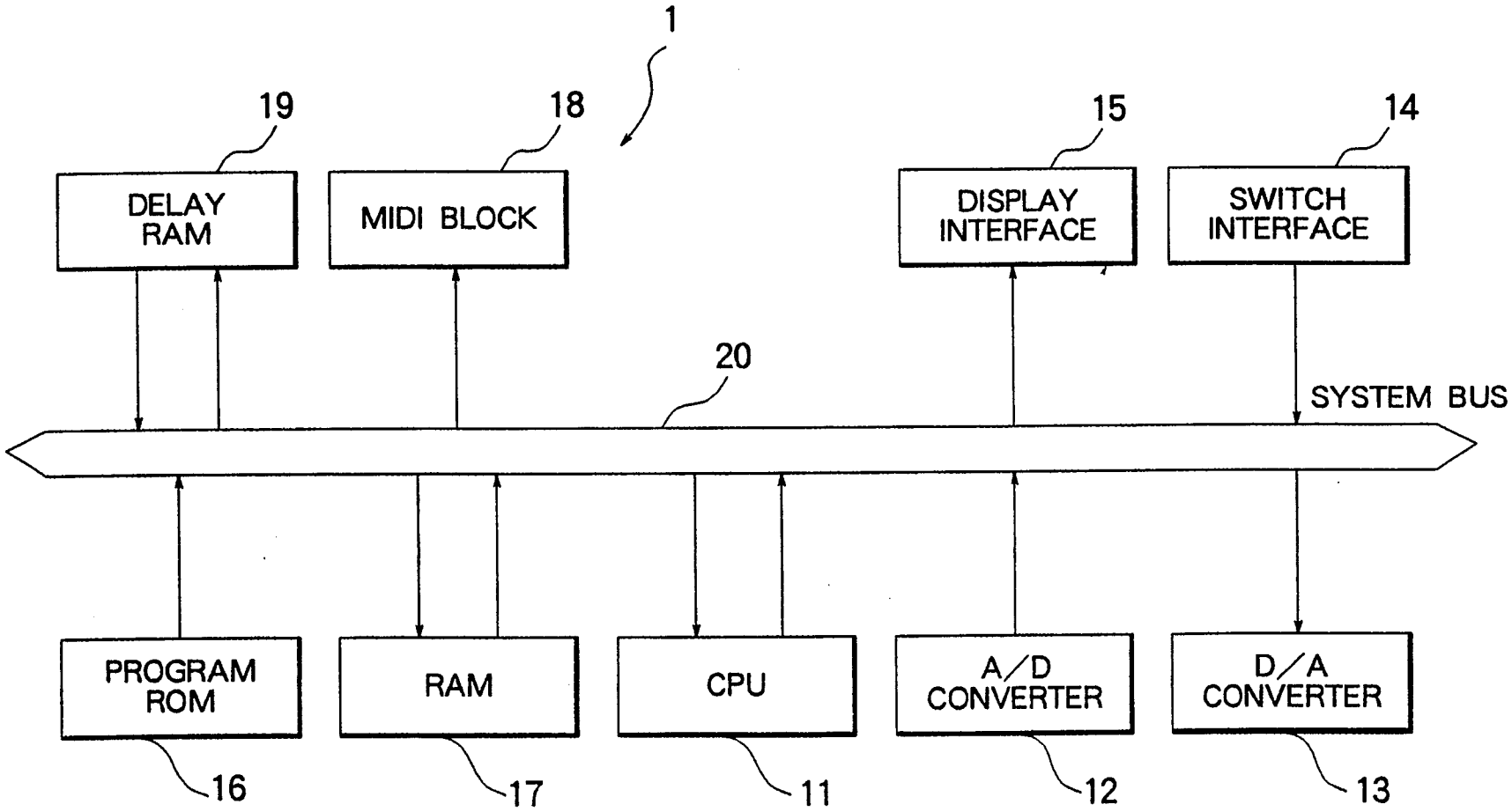
FIG. 2 is a block diagram showing the whole arrangement of the sound effect creating device which is common to the first embodiment and a second embodiment of the invention.

The arrangement of the sound effect-creating device of the second embodiment is similar to that of the first embodiment shown in FIG. 2. In the present embodiment, the CPU 11 performs various control including the delaying operation of the musical tone signal and preparation of the MIDI signal data. ON/OFF signals generated by the switches 23, 24, and 5 are transmitted via the switch interface 14 to the CPU 11.

The RAM 17 temporarily stores results of calculation by the CPU 11, values of time delay time and the tempo set by the operator, etc. The MIDI block 18 converts the signal of the timing clock delivered from time CPU 11 into a predetermined serial data signal so as to transmit the MIDI signal via the MIDI signal connector 27 to the external electronic musical instrument, not shown.

The sound effect-creating device according to the second embodiment is used in the following manner: The device is connected to external devices or systems, similarly to the first embodiment. Then, the delay time is set as desired by operating the switches 23 and/or 24. Accordingly, the basic delay time and the tempo of the performance corresponding to the basic delay time are indicated on the display 2.

In this connection, normally, the basic delay time designates a delaying time period corresponding to duration of one quarter note, and the delay time can be set or changed by the use of the meter-setting switch 5, depending on the conditions of the performance, i.e. depending on the meter of the performance, as described hereinabove with the first embodiment.

By the above settings, a signal indicative of a musical tone or a voice input to the sound effect-creating device 1 is delivered from the connector 8 to an audio amplifier, not shown, after the lapse of the delay time set as above. When the audio amplifier mixes the signal indicative of the voice directly supplied thereto from the microphone and the delayed signal supplied from the sound effect-creating device 1, a loudspeaker, which is supplied with the resulting mixed signal, generates a tone of voice, not delayed, and a tone of voice, delayed, simultaneously, imparting a repeat effect to the song.

Further, the timing clock corresponding to the delay time set as above is transmitted from the MIDI signal connector 27. Therefore, the electronic musical instrument is played in synchronism with the timing clock supplied thereto, which makes it possible to make the delay time for delaying the musical tone (voice) and the tempo of performance of the electronic musical instrument completely synchronous, and hence to impart an excellent repeat effect to the performance (song).

When the delay time is to be changed, the switch 23 or 24 is depressed to automatically change the basic delay time and hence an indication thereof on the display 2, as well as the delay time for delaying the musical tone. In this connection, the tempo is also set by the switch 23 or 24, it is possible to determine the delay time for delaying the musical tone and the tempo of performance of the electronic musical instrument through setting of the tempo. Further, when the meter is set by operating the switch 5, the delay time is changed or determined to a value suitable for the meter, which makes it possible to change the delay time alone without changing the period of the timing clock of the MIDI signal. In this case, the meter is indicated on the display 2.

Next, the operation of the sound effect-creating device 1 will be described in detail with reference to FIG. 7 to FIG. 10. The device is started according to the starting routine described hereinabove with reference to FIG. 3 showing the first embodiment.

Figure 7:
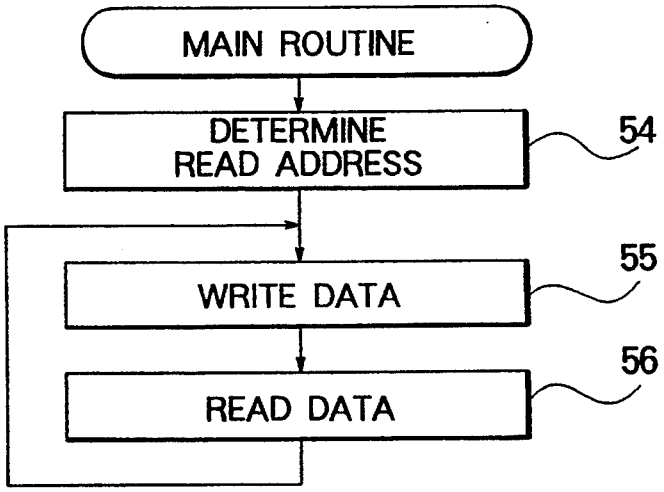
FIG. 7 is a flowchart of a main routine for controlling the operation of the sound effect-creating device according to the second embodiment.

Next, a main routine carried out by the sound effect-creating device of the second embodiment will be described with reference to FIG. 7. The CPU reads data of initial settings to the device stored in the RAM 17 when the power switch 6 is turned on, and indicates them on the display 2. When the switch 23 or 24 is depressed for setting a desired delay time period, the CPU 11 receives data on the ON/OFF state of the switch 23 or 24 via the switch interface 14, and sets and indicates the basic delay time to a shorter or longer time period in a manner proportional to duration of the ON state of the switch 23 or 24. Further, the tempo corresponding to the basic delay time is also determined and indicated on the display 2. While the above settings and indications based thereon are carried out, the CPU determines a read address of the delay RAM 19 corresponding to the delay time at a step 54. The determination of the read address is carried out in the same manner as described with the first embodiment. The read address determined at the step 54 corresponds to the basic delay time which is equal to duration of one quarter note, and if the delay time is to be determined in a manner suitable for a meter, the read address is determined depending on the meter set by the meter-setting switch, as has been described hereinabove with the first embodiment. Further, writing of data into the delay RAM 19 at a step 55 and reading of data from same at a step 56 are also carried out in the same manner as in the first embodiment.

Figure 8:
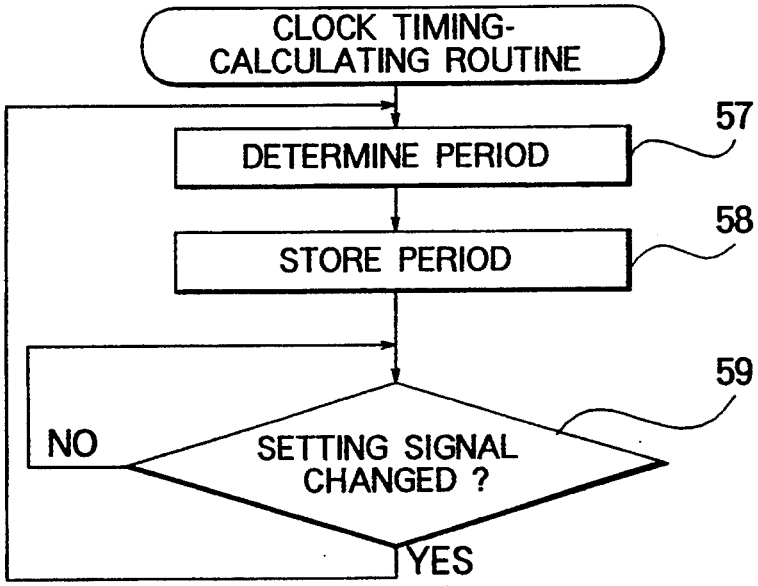
FIG. 8 is a flowchart of a routine for determining a period of a timing clock of a MIDI signal, which is executed by the sound effect-creating device according to the second embodiment.

Then, the calculation of the period of the timing clock of the MIDI signal will be described with reference to FIG. 8. First, the period of the timing clock is calculated at a step 57 from the basic delay time set as described above. The calculation is carried in the following manner: Since twenty-four timing clocks are generated per one quarter note, the period of the timing clock is calculated by dividing the basic delay time by a divisor of 24.

The resulting quotient, i.e. the period of the timing clock is stored into the RAM 17 at a step 58. Then, the CPU 11 constantly monitors whether an ON/OFF signal from the switch 23 or 24 for setting the basic delay time is supplied from the switch interface 14. When it is supplied, i.e., the basic delay time is changed, the program returns to the step 57 (step 59).

Figure 9:
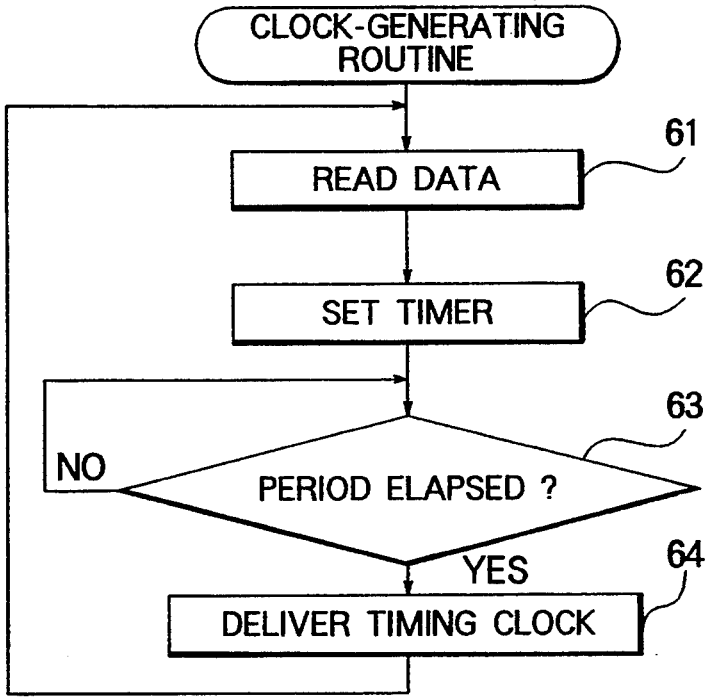
FIG. 9 is a flowchart of a clock generating routine for generating the timing clock of the MIDI signal, which is executed by the sound effect-creating device according to the second embodiment.
Figure 10:
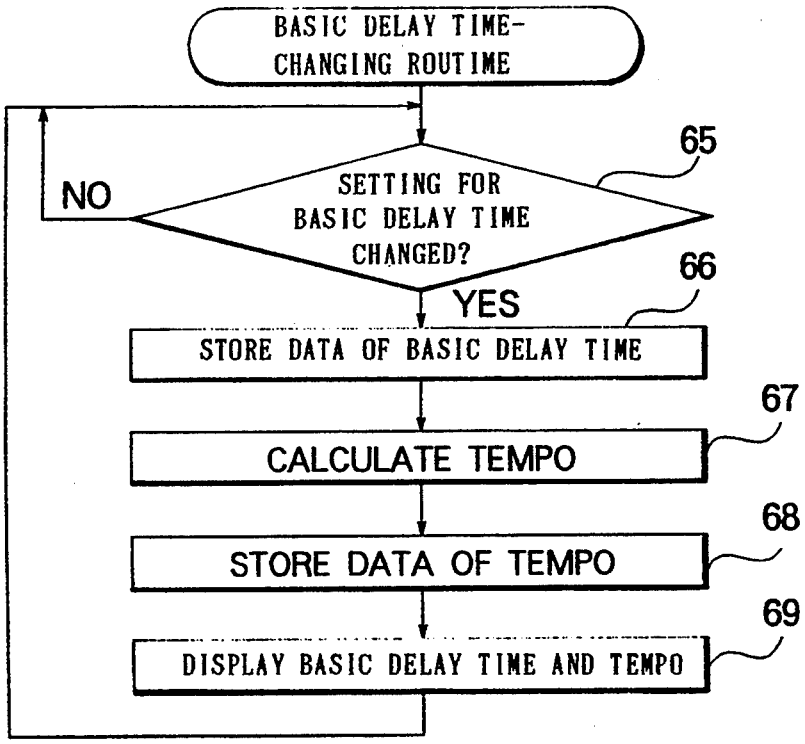
FIG. 10 is a flowchart of a basic delay time-changing routine for changing a basic delay time, which is executed by the sound effect-creating device according to the second embodiment.

Next, a clock generating routine will be described with reference to FIG. 9. The CPU 11 reads data of the period of the timing clock from the RAM 17 at a step 61, and a value of the period is set to a timer, not shown, at a step 62. Then, the CPU 11 checks for the lapse of a time period corresponding to the set value of the period of the timing clock, whenever a predetermined very short time period elapses at a step 63. Each time the time period corresponding to the period of the Liming clock elapses, the CPU 11 allows the timing clock to be delivered from the MIDI interface block 18 to the electronic musical instrument at a step 64.

Then, a basic delay time-changing routine will be described with reference to FIG. 9. According to this routine, the CPU 11 constantly checks for change of setting of the basic delay time at a step 65. If the basic delay time is changed, new data of the basic delay time are stored into the RAM 17 at a step 66. Next, the tempo of the music is calculated based on the data of the basic delay time at step 67. The tempo of the music, which is expressed by the number of quarter notes counted per one minute, is obtained by dividing the 60000 (msec.) by the basic delay time. Thus obtained data of the tempo are stored into the RAM 17 at a step 68.

The data of the tempo and the basic delay time determined as above are read from the RAM 17, and supplied via the display interface 15 to the display 2 to indicate them thereon at a step 69. Thereafter, the program returns to the step 65, for repeated execution of the basic delay time-setting routine.

Although, in the present embodiment, description is made mainly on the case where the delay time for delaying the musical tone and the period of the timing clock of the MIDI signal are determined by setting the basic delay time, it goes without saying that similar results can be obtained by setting the tempo.

As described heretofore, according to the present embodiment, it is possible to delay the musical tone, by setting the basic delay time or the tempo, and further depending on the meter, if required, and at the same time allow the MIDI signal to be transmitted to the external electronic musical instrument at timing dependent on the basic delay time or the tempo. Therefore, it is possible to make the delay time for delaying the musical tone completely synchronous with the tempo of performance of the electronic musical instrument, accordingly imparting an excellent repeat effect to the performance.

Further, it is to be understood that the present invention is not limited to the preferred embodiments described above. For example, various changes and modifications may be made to details of the routines carried out by the sound effect-creating device. Further, in the above embodiments, an adder or mixer for adding up the signal of the musical tone which is not delayed and the delayed signal of same is provided externally of the present sound effect-creating device. This adder may be provided internally of the present device. In this case, the CPU 11 reads data stored at the read address and data stored at the address 0000 at the same time to add them up. Further, if a plurality of read addresses are provided for reading data therefrom to add them up, it is possible to generate a plurality of repeated tones, imparting an even more excellent repeat effect to the musical tone.

Further, if the tempo of the music is to be changed during the performance, data may be stored in the RAM in advance for automatically changing the tempo.

What is claimed is:

1. A sound effect-creating device for imparting a repeat effect to a musical tone produced by performance, including delay means for delaying a musical tone signal of analog or digital type by a predetermined delay time for repeatedly generating said musical tone, said sound effect-creating device comprising:

MIDI signal-receiving means for receiving a MIDI signal for control of a musical instrument;

basic delay time-calculating means for calculating a basic delay time based on a period of a timing clock of said MIDI signal received by said MIDI signal-receiving means; and delay time-setting means for setting said predetermined delay time based on said basic delay time calculated by said basic delay time-calculating means.

2. A sound effect-creating device according to claim 1, further including tempo determining means for determining a tempo of performance of said musical tone based on the period of the timing clock of said MIDI signal received by said MIDI signal-receiving means, and wherein said basic delay time-calculating means calculates said basic delay time based on said tempo determined by said tempo determining means.

3. A sound effect-creating device according to claim 1, wherein said delay time-setting means includes meter-setting means for setting a parameter indicative of a meter of said musical tone, and sets said predetermined delay time based on said basic delay time, and depending on said parameter indicative of said meter of said musical tone.

4. A sound effect-creating device according to claim 2, wherein said delay time-setting means includes meter-setting means for setting a parameter indicative of a meter of said musical tone, and sets said predetermined delay time based on said basic delay time, and depending on said parameter indicative of said meter of said musical tone.

5. A sound effect-creating device for imparting a repeat effect to a musical tone produced by performance, including delay means for delaying a musical tone signal of analog or digital type by a predetermined delay time for repeatedly generating said musical tone, said sound effect-creating device comprising:

basic delay time-setting means for setting a basic delay time for use in setting said predetermined delay time;

MIDI signal-delivering means for delivering a MIDI signal for control of a musical instrument;

timing setting means for setting a period of a timing clock of said MIDI signal based on said basic delay time set by said basic delay time-setting means.

6. A sound effect-creating device according to claim 5, wherein said basic delay time-setting means includes tempo determining means for determining a tempo of performance of said musical tone, and sets said basic delay time based on the tempo set by said tempo setting means.

7. A sound effect-creating device according to claim 6, wherein said delay time-setting means further includes meter-setting means for setting a parameter indicative of a meter of said musical tone, and sets said predetermined delay time based on said tempo set by said tempo setting means and said parameter indicative of said meter of said musical tone.

* * * * *